US008941486B1

(12) United States Patent
Forde et al.

(10) Patent No.: US 8,941,486 B1
(45) Date of Patent: Jan. 27, 2015

(54) RADIO FREQUENCY DETECTION DEVICE AND SYSTEM

(71) Applicant: Cell Busters, LLC, Phoenix, AZ (US)

(72) Inventors: Derek Forde, Phoenix, AZ (US); George O'Dowd, Naas (IE)

(73) Assignee: Cell Busters, LLC, Phoenix, AZ (US)

( * ) Notice: Subject to any disclaimer, the term of this patent is extended or adjusted under 35 U.S.C. 154(b) by 147 days.

(21) Appl. No.: 13/675,513

(22) Filed: Nov. 13, 2012

(51) Int. Cl.
*G08B 1/08* (2006.01)

(52) U.S. Cl.
USPC ..... 340/539.11; 340/539.1; 340/539.21; 340/539.23; 340/573.1

(58) Field of Classification Search
USPC ..... 340/539.11, 539.1, 539.21, 539.23, 340/572.1, 572.4, 573.1, 686.1; 455/414.1, 455/418, 422.1, 434, 456, 456.1; 235/380, 235/381
See application file for complete search history.

(56) References Cited

U.S. PATENT DOCUMENTS

| | | | | |
|---|---|---|---|---|
| 7,010,298 | B2 * | 3/2006 | Seedman et al. | 455/434 |
| 8,576,064 | B1 * | 11/2013 | Mitchell | 340/539.11 |
| 2013/0150004 | A1 * | 6/2013 | Rosen | 455/414.1 |

* cited by examiner

*Primary Examiner* — Hung T. Nguyen
(74) *Attorney, Agent, or Firm* — Booth Udall Fuller, PLC

(57) ABSTRACT

A radio frequency detection device that includes a housing, a power supply port, a radio frequency circuit board, and a microprocessor is disclosed. The radio frequency detection device is configured to detect signals between approximately 20 Mhz and 6020 Mhz. The microprocessor is configured to report the frequency and decibel level of a detected signal to a computer for display on a user interface. A user may set an alert frequency range and an decibel sensitivity threshold to filter out certain devices. The microprocessor is configured to initiate an alert when any signal is detected, or when a signal within either or both the alert frequency range or the decibel sensitivity threshold is detected. The alert may include pulsing of LED lights on the housing, a message on the user interface, and/or broadcast of an audio alert from a speaker associated with the microprocessor.

20 Claims, 3 Drawing Sheets

RADIO FREQUENCY DETECTION DEVICE AND SYSTEM

BACKGROUND

1. Technical Field

Aspects of this document relate generally to radio frequency detection devices.

2. Background Art

Cell phone detectors are often used in various settings to detect any cell phones within range of the cell phone detector. While useful in a few settings, previous cell phone detectors are limited in the range of the frequencies detected by the cell phone detector, thus many electronic communication devices are often not detected by cell phone detectors previously known in the art. Moreover, previous cell phone detectors typically do not allow a user to distinguish between the types of device detected. Nor do previous cell phone detectors allow a user to eliminate inconsequential devices that are detected by the cell phone detector.

SUMMARY

Aspects and applications of the disclosure presented herein are described below in the drawings and detailed description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

In one aspect, this document features a radio frequency detection device. The radio frequency detection device comprises a housing, a power supply port, a radio frequency (RF) circuit board housed within the housing, and a microprocessor. The RF circuit board is electrically coupled to the power supply port and comprises an internal antenna. The microprocessor is housed within the housing and electrically coupled to the power supply port and the RF circuit board. The microprocessor is configured to report a frequency of a detected signal, report a decibel level of the detected signal, initiate an alert when the detected signal is within one or more adjustable alert ranges, and ignore the detected signal when the detected signal is not within the one or more adjustable alert ranges.

Particular embodiments may comprise one or more of the following. The RF circuit board and the microprocessor may be configured to detect frequencies between approximately 20 Mhz and 6020 Mhz, and the microprocessor may comprise a 32 bit microprocessor. The one or more adjustable alert ranges may comprise an adjustable alert frequency range and a decibel sensitivity threshold. The alert may comprise one or more audio messages broadcast from a speaker electrically coupled to the microprocessor. The one or more audio messages may comprise a plurality of audio messages and the microprocessor may be further configured to initiate a different one of the plurality of recorded messages upon detection of different signal frequencies or decibels. The power supply port may comprise at least one of an Ethernet port, a USB port, and AC adapter port, and an internal battery, and the microprocessor may be further configured to communicate with one or more external devices through at least one of the Ethernet port and the USB port.

In another aspect, a method of monitoring unauthorized use of one or more devices emitting a radio frequency in a secure area. The method comprises operably coupling a computer comprising an user interface to a first radio frequency detection device, the first radio frequency detection device comprising a microprocessor, a radio frequency circuit board comprising an antenna, and a communication port, setting, through the user interface, a frequency alert range, detecting, with the first radio frequency detection device, a signal of one or more devices, the signal of the one or more devices comprising a frequency and a decibel level, initiating, by the microprocessor, an unauthorized use alert when the frequency of the signal detected by the first radio frequency detection device is within the frequency alert range, and ignoring the one or more devices by not initiating the unauthorized use alert when the frequency of the signal detected by the first radio frequency detection device is not within the alert frequency range.

Particular embodiments of the method may comprise one or more of the following. The method may further comprise setting, through the user interface, a sensitivity threshold. Initiating the unauthorized use alert may comprise initiating, by the microprocessor, the unauthorized use alert when the frequency of the signal detected by the first radio frequency detection device is within the frequency alert range and the decibel level of the signal detected is above the sensitivity threshold. Ignoring the one or more devices may comprise ignoring the one or more devices by not initiating the unauthorized use alert when the frequency of the signal detected by the first radio frequency detection device is not within the alert frequency range or the decibel level of the signal detected is below the sensitivity threshold. Initiating the unauthorized use alert may comprise initiating, by the microprocessor, the unauthorized use alert when the signal detected comprises an extended time signal, the frequency of the signal detected by the first radio frequency detection device is within the frequency alert range, and the decibel level of the signal detected is above the sensitivity threshold. Ignoring the one or more devices may comprise ignoring the one or more devices by not initiating the unauthorized use alert when the signal detected comprises an automatic registration signal, the frequency of the signal detected by the first radio frequency detection device is not within the alert frequency range, or the decibel level of the signal detected is below the sensitivity threshold. Initiating, by the microprocessor, the alert may comprise initiating, by the microprocessor, an audio alert message broadcast by a speaker electrically coupled to the microprocessor. The method may further comprise initiating an external security device operably coupled to the first radio frequency detection device when the decibel level of the signal detected by the first radio frequency detection device is above the decibel sensitivity threshold or the frequency of the signal detected by the first radio frequency detection device is within the alert frequency range. Operably coupling the computer may comprise operably coupling a computer comprising the user interface to the first radio frequency detection device with a communication cord extending between the computer and a communication port on the first radio frequency detection device, the communication port being electrically coupled to the microprocessor. Operably coupling the may comprise operably coupling the computer comprising the user interface to the first radio frequency detection device through a network. The method may further comprise operably coupling the computer to a second radio frequency detection device and at least a third radio frequency detection device, the second and at least third radio frequency detection devices each comprising a microprocessor, a radio frequency circuit board comprising an antenna, and a communication port. The method may further comprise setting, through the user interface, a frequency alert range for the second and at least third radio frequency detection devices. The method may further comprise setting, through the user interface, a sensitivity threshold for the second and at least third radio frequency detection devices. The method may further comprise detecting, with the second and third radio frequency detection devices, the signal of the one or more devices. The method may further comprise initiating, by the microprocessor of the second and third radio frequency detection devices, an unauthorized use alert when the frequency of the signal detected by the second and third radio frequency detection devices is within the frequency alert range or above the sensitivity threshold. The method may further comprise ignoring the one or more devices by not initiating the unauthorized use alert when the frequency of the signal detected by the second and at least third radio frequency detection devices is not within the alert frequency range or the decibel level of the signal detected is below the sensitivity threshold. The method may further comprise determining a location of the one or more devices by comparing the decibel level of the signal at each of the first, second, and at least third radio frequency detection devices. The method may further comprise showing the location of the one or more devices on a map on the user interface. The method may further comprise detecting a unique identifier number of the one or more devices, reporting the frequency of the signal, the decibel level of the signal, and the unique identifier number of the one or more devices to the computer; and recording the frequency of the signal, the decibel level of the signal, and the unique identifier number of the one or more devices in a database.

In another aspect a system for monitoring unauthorized use of one more devices emitting a radio frequency in a secured area is disclosed herein. The system may comprise one or more computers each configured to display a user interface, and one or more radio frequency detection devices operably coupled to the one or more computers. Each of the one or more radio frequency detection devices comprises a power supply, a radio frequency circuit board electrically coupled to the power supply, an antenna, and a microprocessor electrically coupled to the power supply port and the radio frequency circuit board. The microprocessor is configured to report a frequency of one or more detected signals to the one or more computers, report a decibel level of the one or more detected signals to the one more computers, and initiate an unauthorized use alert when the frequency of one or more detected signals is within an adjustable alert frequency range. The adjustable alert frequency range is adjustable through the user interface and the user interface is configured to display the frequency and the decibel level of the one or more detected signals reported to the one or more computers.

Particular embodiments may comprise one or more of the following. The microprocessor may be configured to initiate the unauthorized use alert when the decibel level of the one or more detected signals is above an adjustable decibel sensitivity threshold, the adjustable decibel sensitivity threshold being adjustable through the user interface. The one or more radio frequency detection devices may comprise a plurality of radio frequency detection devices operable coupled to the one or more computers over a network. The system may further comprise an external security device operably coupled to at least one of the plurality of radio frequency detection devices and responsive to initiate a security measure when the microprocessor initiates the alert. The alert may comprise an audio alert message broadcast by a speaker electrically coupled to the microprocessor.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

The invention will hereinafter be described in conjunction with the appended drawings, where like designations denote like elements, and.

DESCRIPTION

This disclosure, its aspects and implementations, are not limited to the specific components or assembly procedures disclosed herein. Many additional components and assembly procedures known in the art consistent with the intended radio frequency detection device and/or assembly procedures for a radio frequency detection device will become apparent for use with embodiments of radio frequency detection devices from this disclosure. Accordingly, for example, although particular microprocessors, networks, cords, adapters, computers, databases, antennas and the like are disclosed, such elements and implementing components may comprise any shape, size, style, type, model, version, measurement, concentration, material, quantity, and/or the like as is known in the art for such radio frequency detection devices and implementing components, consistent with the intended operation of a radio frequency detection device.

Radio frequency (RF) detection devices are often used to detected devices emitting a radio frequency, such as a cell phone. Previous RF detection devices, however, are limited in functionality by only including an alert that is activated any time any signal is detected. Thus, it is impossible with standard RF detection devices to filter out inconsequential devices in a proscribed area while still being alerted to unwanted devices in the same area. Various embodiments of an RF detection device disclosed herein allow users to monitor or detect use of devices emitting a RF signal within a particular area. For example, a user may wish to monitor or detect use of a device within a certain area of a building. Embodiments of the RF detection devices disclosed herein allow a user to monitor or detect such a device by allowing a user to adjust ranges of decibel levels (or sensitivity) detected and ranges of frequency detected. By setting a range of certain decibel levels, the user may filter out devices that may be outside the range of the proscribed area. By setting a range of certain frequencies, a user may filter out certain devices. Thus, as shall be shown herein, a user may configure embodiments of the RF detection device 10 disclosed herein to initiate one or more alerts when a device is detected at a predetermined decibel level and with a predetermined frequency or within a predetermined frequency range.

Figure 1:
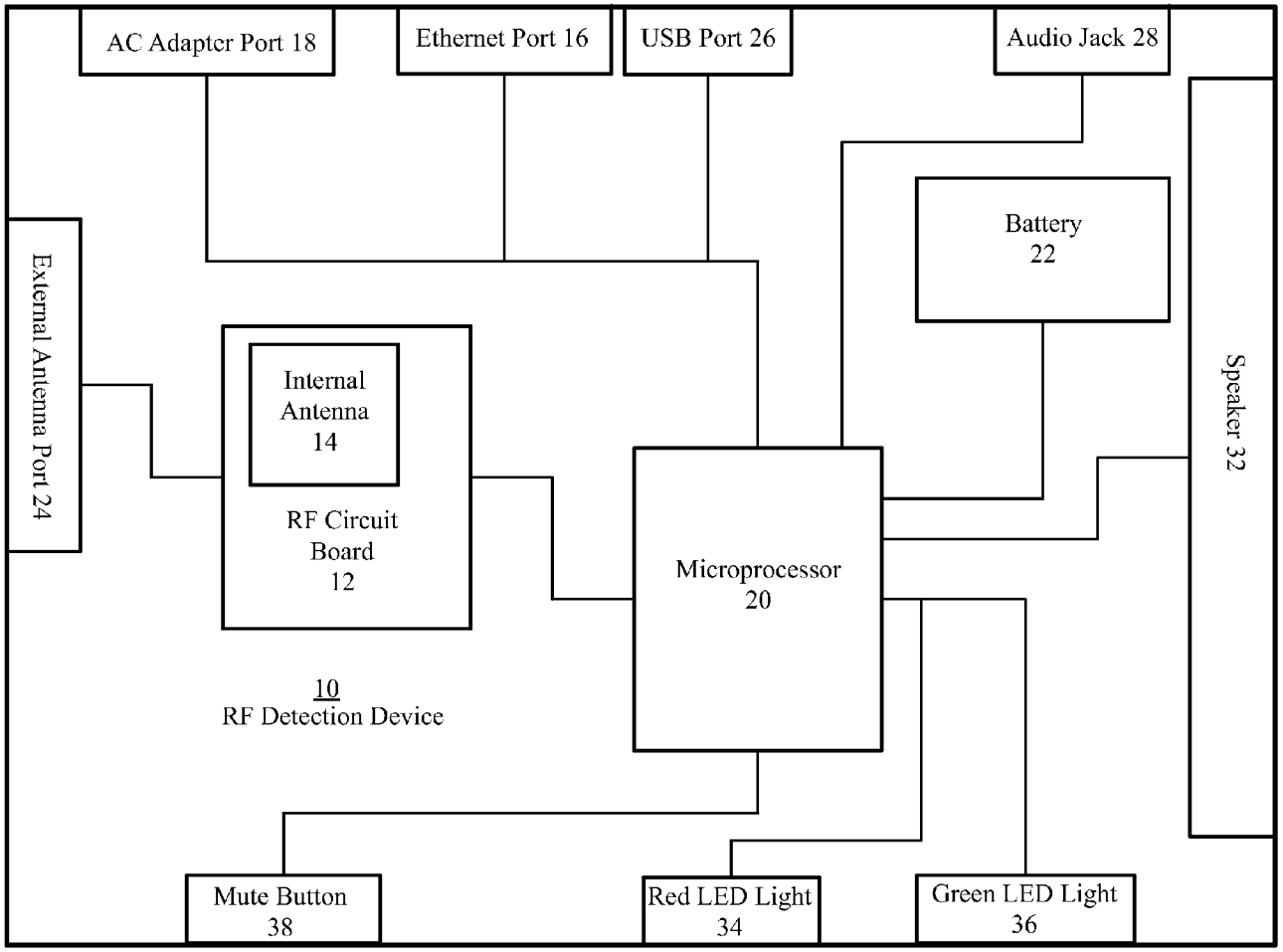
FIG. 1 is a block diagram of a radio frequency detection device.

FIG. 1 is an exemplary block diagram of a radio frequency (RF) detection device 10. As shall be described in greater detail throughout this document, the RF detection device 10 is configured to detect RF off-air energy and, as proscribed by a user, raise an alert. In various embodiments, the RF detection device 10 comprises an RF circuit board 12 and a microprocessor 20. The RF circuit board 12 comprises an internal antenna 14 configured to, in some embodiments, allow the RF detection device 10 to detect RF between approximately 20 MHz and 6020 MHz (6 Ghz). In other embodiments, ranges detected by the RF detection device 10 greater than or less than 20 MHz to 6020 MHz (6 Ghz) are also contemplated. As shall be described in greater detail, through the RF circuit board 12, the RF detection device 10 detects RF signal levels above an adjustable threshold or, optionally, enveloped modulation analysis within adjustable criteria. The RF circuit board 12 comprises, in various embodiments, any circuit board known in the art and suitable for converting a signal received by internal antenna 14 (or any other antennas electrically coupled to RF circuit board 12) to a frequency for processing in microprocessor 20. Detection of RF by the RF circuit board 12 may comprise one or more detection types, such as but not limited to a wideband logarithmic envelope detector and a tuned logarithmic envelope detector.

The internal antenna 14 comprises, in various embodiments, any wideband patch type antenna or any other antennas known in the art and suitable for detecting RF. In some embodiments, the RF detection device 10 comprises an external antenna port 24 on the housing of the RF detection device 10 electrically coupled to the RF circuit board 12. According to one aspect, the external antenna port 24 comprises a 50 Ohm subminiature version A (SMA) jack configured to removably couple to an antenna.

The RF detection device 10 further comprises a microprocessor 20 electrically coupled to RF circuit board 12. The microprocessor 20 may comprise any configuration to carry out any or all of the various features of the radio frequency monitoring system described throughout this document, such as but not limited to a 32 bit microprocessor or a 16 bit microprocessor. In the embodiment shown in the block diagram of FIG. 1, the microprocessor 20 comprises a 32 bit microprocessor.

Embodiments of the RF detection device 10 further comprise one or more power supplies or power supply ports. The embodiment shown in the block diagram of FIG. 1 comprises a battery 22, an Ethernet port 16, an AC adapter port 18, and a USB port 26. Each of these ports 16, 18, 26 may comprise any port known in the art. In a particular embodiment, Ethernet port 16 comprises an RJ45 10/100 BASE-T Ethernet port with standard isolated power-over-ethernet (POE) extraction, AC adapter port 18 comprises a DC jack with 2.1 mm center positive, and USB port 26 comprises a type B connector. Specific embodiments comprising a battery may include a 9.6 NiMH battery. Other batteries known in the art suitable for detection devices may likewise be substituted in place of a 9.6 NiMH battery. While the embodiment shown in FIG. 1 comprises each of a battery 22, an Ethernet port 16, an AC adapter port 18, and a USB port 26, other embodiments may comprise one or more of each of these. Moreover, each of the battery 22, Ethernet port 16, AC adapter port 18, and USB port 26 is typically electrically coupled to the microprocessor 20 either directly or indirectly, and each may likewise be electrically coupled directly or indirectly to any other elements of the RF detection device 10, such as but not limited to the RF circuit board 12, the external antenna port 24, the remote audio jack 28, the speaker 32, the red LED lights 34, the green LED lights 36, and/or the mute button 38.

Various embodiments of the RF detection device 10 further comprise at least one speaker 32 electrically coupled to microprocessor 20. The speaker 32 may comprise any speaker configured to broadcast a message or audio signal. In particular embodiments, the speaker 32 comprises a 50 mm loudspeaker of 1.5 watts the broadcasts at approximately 85 dB as measured 1 meter from the speaker.

Various embodiments of the RF detection device 10 further comprise one or more green LED lights 36 that turn off and on responsive to actuation from microprocessor 20. In typical embodiments, the green LED lights 36 are initiated or turned on when detection device 10 is ready to detect signals or is currently searching for signals. Various embodiment of the RF detection device 10 further comprise one or more red LED lights that turn off and on responsive to actuation from microprocessor 20. In typical embodiments, the red LED lights 34 are initiated or turned on for detection device 10 to alert a user that a device emitting a radio frequency has been detected. Embodiments may also comprise an amber LED electrically coupled to microprocessor 20 that, when initiated, indicates battery 22 is low. In some embodiments, one or more of the green LED lights 36, red LED lights 34, and/or amber LED lights may comprise a single LED light that changes color.

Various embodiments of the RF detection device 10 further comprise one or more of the following: a mute button 38 electrically coupled to the microprocessor 20, an external audio port, a battery on-off switch, a reset switch, and a cover switch. The mute button 38 is typically configured to cancel the playing of an alert through speaker 32. The audio port may comprise an alternative audio output 3.5 mm stereo 600 Ohm line level.

Figure 2:
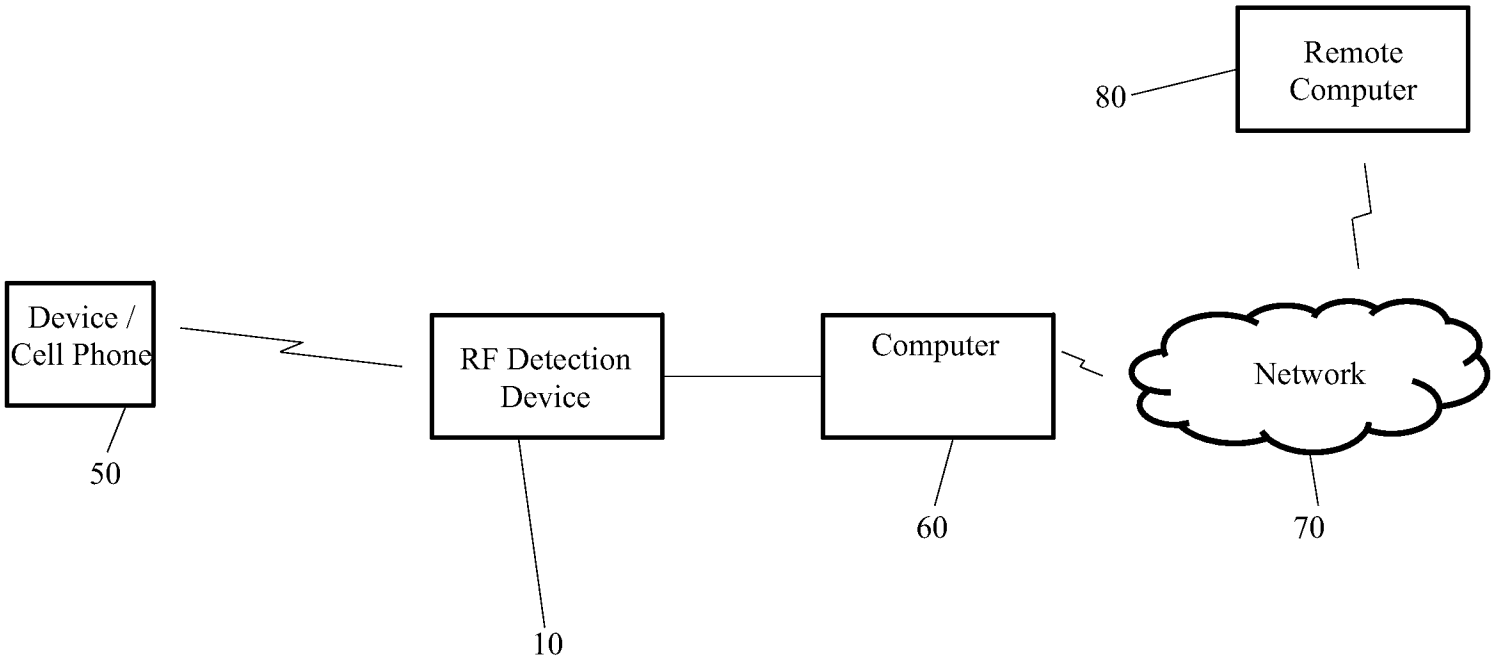
FIG. 2 is a block diagram of a radio frequency detection system.

With reference to the diagram of FIG. 2, an embodiment of the RF detection device 10 is further configured to communicate with one or more computers 60. In some embodiments, the RF detection device 10 communicates with a computer 60 electrically coupled to the RF detection device 10 through an Ethernet cord coupled to Ethernet port 16. In other embodiments, a wireless communication device may be coupled to the USB port 26. The wireless communication device may then communicate with the computer 60 over a wireless network. In still other embodiments, the RF detection device 10 is electronically or operably coupled to the computer 60 with an Ethernet cord, and one or more remote computers 80 may communicate with the RF detection device 10 through the computer 60 over the network 70. The network 70 may comprise any network known in the art, such as but not limited to a LAN, MAN, SAN, DAN, and/or CAN network. When operably coupled to the remote computer 80 or the computer 60, a user may control the RF detection device 10 or monitor radio frequencies within an area of the RF detection device 10 through a user interface displayed on the remote computer 80 or the computer 60. Various embodiments of the RF detection device 10 are configured to allow a unique IP address or MAC address to be assigned to that specific the RF detection device 10. Assignment of a unique IP address for each RF detection device 10 enables a user to remotely monitor each RF detection device 10, change the settings, and capture the logged data to centralized management software.

The microprocessor 20 is further configured to communicate with the computer 60 and/or one or more remote computers 80. In some embodiments, the microprocessor 20 is configured to report a specific numeric frequency of a detected signal emitted from one or more devices 50 to the computer 60 or the remote computer 80. The microprocessor 20 is typically further configured to report a decibel level of the detected signal to the computer 60 or the remote computer 80. A user interface on the computer 60 or the remote computer 80 then typically displays the frequency and/or the decibel level of the detected signal. The microprocessor 20 is, in various embodiments, configured to include the software necessary to display a user interface coupled to the RF detection device 10 with an Ethernet cord. Software included or otherwise incorporated with the microprocessor 20 is configured to allow a user to control aspects of the RF detection device 10 described in throughout this document. In general, the user interface displayed on either the computer 60 or the remote computer 80 may comprise a web interface that allows a user to activate or deactivate radio frequency detection, monitor system uptime, monitor the RF detection device 10 status, adjust the volume of audio alert broadcast by the speaker 32, activate the mute button 38, adjust the time between alerts, activate or deactivate relay inhibition of radio frequency detection, uploading of audio files to be broadcast as an alert by the speaker 32, select detection channel, name a detection channel, set an alert frequency range, set an alert decibel (or sensitivity) range, select the audio alert to be broadcast by the speaker 32, and/or set the visual alert of the LED lights 34.

In particular embodiments, the RF detection device 10 is configured to scan and report all detected signals and their decibels within the approximately 20 Mhz to 6 Ghz range. Reporting of the frequency and decibel of the one or more detected signals is typically displayed on the user interface of the computer 60 or the remote computer 80, as shall be described in greater detail throughout this document. Detection within this range includes but is not limited to frequencies associated with devices utilizing GSM (USA), GSM (Europe), LTE, CDMA, Wifi, Wimax, 2G, 3G, 4G, Bluetooth, Zigbee, RFID, 2 way radios, and/or low frequency radio bugs. In some embodiments, RF detection device 10 includes preset configurations set to specifically search for devices utilizing one or more of the frequencies associated with GSM (USA), GSM (Europe), LTE, CDMA, Wifi, Wimax, 2G, 3G, 4G, Bluetooth, Zigbee, RFID, 2 way radios, and/or low frequency radio listening devices (often referred to as "bugs"). The approximate range of detection may comprise from approximately 100 feet to approximately 1 to 2 feet of the RF detection device 10.

Embodiments may also be configured to identify, log, and report all detected WLAN devices detected. Any alert described throughout this document may be initiated by the microprocessor 20 when a new WLAN device is detected or an existing WLAN signal is lost. Moreover, embodiments of the RF detection device 10 also report the MAC addresses or other identification of devices attempting to connect to WLAN devices.

In particular embodiments, the microprocessor 20 is configured to initiate an alert on one or more alerting elements upon detection of a detected signal. One or more alerting elements may comprise at least one of the red LED lights 34, the green LED lights 36, a message or notification on the user interface, an audio alert (such as a WAV file) broadcast by the speaker 32, an alert via SNMP/XML over the Ethernet or network to a computer 60 or remote computer 80, or a record to a buffer/activity log stored on the microprocessor 20, the computer 60, or the remote computer 80. In an embodiment, an alert log is stored in memory or a database associated with the microprocessor 20. The memory or database may be housed within the RF detection device 10 or may be housed with the computer 60. The alert log may comprise one or more of the following: device identification, frequency type, signal strength or decibel level, duration of the alert, the date, and/or the time. Various embodiments allow a user to select what alerting element is initiated by the microprocessor 20 upon detection of a signal. For example, an embodiment, the red LED lights 34 may pulse or flash when a signal is detected. Simultaneously or independent of the pulsing of the red LED lights 34, an audio alert may be broadcast by the speaker 32. The audio alert may comprise any audio alert, such as but not limited to a generic audio alert stored in the memory of the RF detection device 10 during manufacture, or alternatively an audio alert recorded by the user.

Various embodiments of the RF detection device 10 are configured to allow a user to set, from the user interface on either the computer 60 or the remote computer 80, at least one decibel sensitivity threshold and at least one alert frequency range. The decibel sensitivity threshold is typically set such that when a signal is detected with a decibel level above the decibel sensitivity threshold, the microprocessor 20 initiates an alert. In some embodiments, the decibel sensitivity threshold is set by first monitoring the decibel levels of all signals detected by the RF detection device 10. A user may then decide, based on specific circumstances, at what decibel levels the microprocessor 20 should not initiate an alert, i.e. what decibel levels should be "ignored" by the microprocessor 20. Thus, only decibel levels above the decibel sensitivity threshold trigger initiation of the alert by the microprocessor 20 once the user has set the decibel sensitivity threshold. Such a configuration is advantageous over previous RF detection devices that do not allow for such accuracy of manipulating the range of detection of the detection device. In some embodiments, a user may set both a lower (or minimum) threshold and an upper (or maximum) threshold. Thus, the microprocessor 20 may be configured to initiate an alert when the decibel level of the detected signal is not only above a lower threshold but also below an upper threshold.

Similarly, the alert frequency range is typically set such that when a signal is detected with a frequency within the alert frequency range, the microprocessor 20 initiates an alert. In some embodiments, alert frequency range is set by first monitoring the frequencies of all signal detected by the RF detection device 10. A user may then decide, based on individual circumstances, at what frequency levels the microprocessor 20 should not initiate an alert, i.e. what frequency levels should be "ignored" by the microprocessor 20. Thus, only frequencies within the alert frequency range trigger initiation of the alert by the microprocessor 20 once the user has set the alert frequency range.

In some embodiments, the decibel sensitivity threshold and alert frequency range are combined into single alert range that incorporates both ranges. For example, in such an alert range, the microprocessor 20 is configured to initiate an alert only when a detected signal comprises both a decibel level within the proscribed range and a frequency within the proscribed range. Moreover, embodiments of the RF detection device 10 allow for a plurality of alert frequency ranges and/or a plurality of decibel sensitivity thresholds to be set by a user. In such embodiments, as described below, the microprocessor 20 may be configured to initiate a different alert for each range. Various embodiments also come with preset alert frequency and decibel sensitivity thresholds typical to certain electronic devices or decibel levels. In particular embodiments, a user may store and name certain ranges of either or both the alert frequency range and the decibel sensitivity threshold. Setting of the decibel sensitivity threshold and the alert frequency range is a significant improvement over previous cell phone detection devices because it allows a user to filter out inconsequential or known devices, such as 2-way radios in a prison setting.

In particular embodiments, the RF detection device 10 is configured to store multiple audio alerts. In such embodiments, a different audio alert to be broadcast by speaker 32 may be initiated by the microprocessor 20 upon detection of different ranges of frequencies detected by the RF detection device 10. For example, a first audio alert may be initiated by the microprocessor 20 upon detection of a signal with a frequency within a first frequency range, a second audio alert may be initiated by the microprocessor 20 upon detection of a signal with a frequency within a second frequency range, and so on.

Embodiments of the RF detection device 10 are further configured trigger another security device when a detected signal comprises a decibel level above the decibel sensitivity threshold and/or a frequency within the alert frequency range. For example, when a device emitting a frequency within the alert frequency range at a decibel above the decibel sensitivity threshold, the microprocessor 20 may initiate a signal that initiates a video camera, a jammer, a door lock, and the like. In such embodiments, the microprocessor 20 communicates with a computer running other software typical to the respective security device. Communication of the microprocessor 20 with a computer running the other software may comprise wired or wireless communication with the computer 60 or the remote computer 80 through any appropriate network.

By way of example and not limitation, the RF detection device 10 may be integrated with a prison security system. Such integration allows the RF detection device 10 to detect certain devices emitting specific frequencies at specific decibel levels. Once detected, the RF detection device 10 may communicate with a prison security system to initiate security devices, such as but not limited to video cameras, jammers, door locks, etc. The RF detection device 10, however, is not limited to prison security systems, but may be integrated with any applicable computer system.

Embodiments of the RF detection device 10 further comprise a cover tamper switch. The cover tamper switch is operably coupled to the microprocessor 20 such that if the RF detection device 10 is tampered with, the microprocessor 20 initiates an alert to at least one of the user interface, the speaker 32, or the red LED lights 34. Communication to and from the RF detection device 10 is also encrypted to prevent unauthorized access.

Also contemplated herein is a method of monitoring or detecting one or more authorized or unauthorized devices emitting a radio frequency signal in a secure area with the RF detection device 10. The secure area may comprise at least one or more of the following: a sensitive compartmented information facility (SCIF), all or part of a casino gaming floors, prisons, military buildings, government buildings, business building or facilities, airplanes, or vehicles such as automobiles, trucks, buses, trains, or motorcycles.

Figure 3:
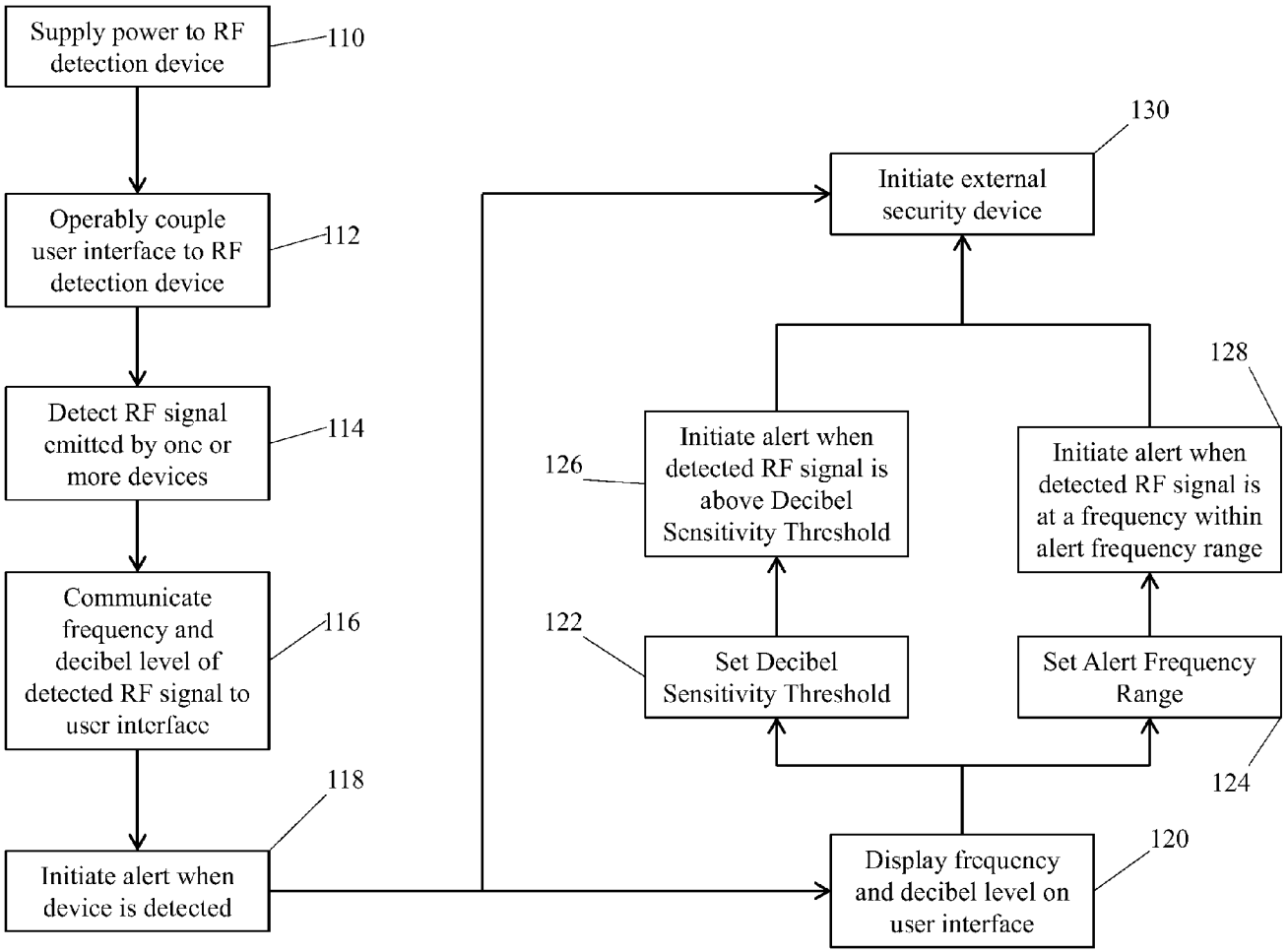
FIG. 3 is a flow diagram of a method of monitoring devices emitting a radio frequency signal.

FIG. 3 illustrates a flow chart of an exemplary embodiment for monitoring one or more devices emitting a radio frequency. Various embodiments of the methods described herein may eliminate some steps or add additional steps without deviating from the contemplated disclosures. Likewise, although steps are shown in a particular order in the flow diagram of FIG. 3, steps presented therein are contemplated in varying orders and are, therefore, not limited to the order presented therein.

In an embodiment, a method comprises supplying power to the RF detection device 10 (step 110). The RF detection device may include any of the elements or variations described throughout this document or otherwise previously known in the art. Supplying power to the RF detection device 10 may, in various embodiments comprise supplying power through an Ethernet cord coupled to Ethernet port 16, an AC cord coupled to AC port 18, an internal battery 22, or a USB cord coupled to USB port 26.

An embodiment of the method further comprises operably coupling a computer 60 or a remote computer 80 that includes a user interface to the RF detection device 10 (step 112). Operably coupling the computer 60 or the remote computer 80 may, in various embodiments, operably coupling the RF detection device to computers 60, 80 through a wired or wireless network. In one embodiment, operably coupling the RF detection device 10 to a computer 60, 80 that includes a user interface comprises operably coupling the RF detection device 10 and the computer 60, 80 with an Ethernet cord. Although coupling through an Ethernet cord is provided as an exemplary connection, any other type of cord known in the art for transferring data or communicating between two electronic devices is also contemplated.

In other embodiments, this step may comprise coupling the RF detection device 10 to computer 60 with an Ethernet cord, computer 60 operably coupled to one or more remote computers 80 to allow for communication between remote computers 80 and the RF detection device 10. Moreover, in still other embodiments, operably coupling the RF detection device 10 to the computer 60 or the remote computer 80 may comprise coupling a wireless device to the RF detection device 10, the wireless device configured to communicate wirelessly with the computer 60 and/or the remote computer 80.

An embodiment of a method for monitoring devices emitting a radio frequency signal further comprises detecting, with the RF detection device 10, radio frequency emitted by one or more devices (step 114). Detecting of the radio frequency with the RF detection device 10 may comprise detecting the radio frequency with an external antenna coupled to the external antenna port 24 or an internal antenna 14 associated with RF circuit board 12. As previously described, various embodiments are configured to detect any frequencies between approximately 20 Mhz and 6020 Mhz. Accordingly, detecting radio frequency emitted by one or more devices may comprise detecting radio frequency emitted by any device utilizing GSM (USA), GSM (Europe), LTE, CDMA, Wifi, Wimax, 2G, 3G, 4G, Bluetooth, Zigbee, RFID, 2-way radio, low frequency radio bugs, and the like.

An embodiment of a method for monitoring devices emitting a radio frequency signal further comprises communicating, by the microprocessor 20, a numeric frequency and a decibel level of the numeric frequency of the signal emitted by each of the one or more devices (step 116). The numeric frequency and the decibel level are typically communicated for display on user interface of the computer 60 or the remote computer 80.

An embodiment of a method for monitoring devices emitting a radio frequency signal further comprises initiating, by the microprocessor 20, an alert when the signal emitted by the one or more devices is detected by RF detection device 10 (step 118). As previously described, the alert initiated may comprise one or more of the initiating LED lights 34, initiating an audio recording or message on speaker 32, or displaying an alert on the computer 60 or the remote computer 80.

An embodiment of a method for monitoring devices emitting a radio frequency signal further comprises displaying, on the user interface, the numeric frequency and the decibel level of the signal detected by the RF detection device 10 (step 120). Displaying the numeric frequency and the decibel level of the signal detected by the RF detection device 10 may comprise displaying the numeric frequency and the decibel level on the user interface of either or both of the computer 60 or the external computer 80.

An embodiment of a method for monitoring devices emitting a radio frequency signal further comprises setting, with the user interface, one or more decibel sensitivity thresholds (step 122). Once the one or more decibel sensitivity thresholds have been set, the microprocessor 20 filters out signals detected below the decibel sensitivity threshold. Thus, the microprocessor 20 does not initiate an alert unless the detected signal comprises a decibel level above the decibel sensitivity threshold. A user may set the decibel sensitivity threshold at either the computer 60 and/or remote computer 80 in various embodiments. In some embodiments, setting the one or more decibel sensitivity thresholds may comprise setting a range with both a minimum and a maximum decibel level.

An embodiment of a method for monitoring devices emitting a radio frequency signal further comprises setting, with the user interface, one or more an alert frequency ranges (step 124). Once the one or more alert frequency ranges have been set, the microprocessor 20 filters out signals detected outside the alert frequency range. Thus, the microprocessor 20 does not initiate an alert unless the detected signal comprises a frequency above the decibel sensitivity threshold. A user may set the alert frequency range at either the computer 60 and/or remote computer 80 in various embodiments. Various embodiments of a method for monitoring devices may incorporate setting the alert frequency range and the decibel sensitivity threshold into a single step such that the microprocessor 20 only initiates an alert when the detected signal comprises both a frequency within the alert frequency range and a decibel level above the decibel sensitivity threshold.

In various embodiments of a method for monitoring devices emitting a radio frequency signal, setting the alert frequency range and/or the decibel sensitivity threshold may comprise setting the alert frequency range and/or the decibel sensitivity threshold before any signals are detected by the RF detection device 10. In other embodiments, setting the alert frequency range and/or the decibel sensitivity threshold may comprise setting the alert frequency range and/or the decibel sensitivity threshold after signals are initially detected by RF detection device 10 and communicated or otherwise reported to the computer 60 or the remote computer 80. Such a configuration allows a user to calibrate the RF detection device to the particular setting, thus ignoring (or not initiating an alert for) inconsequential devices emitting a radio frequency but nonetheless detected by the RF detection device 10.

An embodiment of a method for monitoring devices emitting a radio frequency signal further comprises initiating an alert when the decibel level of the detected signal is above the decibel sensitivity threshold (step 126). The alert may comprise an unauthorized use alert. Similarly, an embodiment of a method for monitoring devices emitting a radio frequency signal further comprises initiating an alert when the frequency of the detected signal is within the alert frequency range (step 128). The alert may comprise an unauthorized use alert. Furthermore, as previously described, some embodiments are configured such that an alert is only initiated by the microprocessor 20 when the detected signal includes both a decibel above the decibel sensitivity threshold and a frequency within the alert frequency range.

An embodiment of a method for monitoring devices emitting a radio frequency signal further comprises initiating, with the microprocessor 20, one or more external security devices when an alert is initiated by the microprocessor 20. In various embodiments, a user may set certain additional security ranges in addition to the alert frequency range or the decibel sensitivity threshold. In other embodiments, however, external security devices may be initiated anytime any alert is initiated by the microprocessor 20. As previously described, the external security device may include video cameras, jammers, door locks, and the like. Moreover, the external security device may be responsive to software separate from the software of RF detection device 10. The microprocessor 20 of the RF detection device 10, however, is configured to communicate with the software of the external security device. This the method of monitoring devices emitting a radio frequency signal to be incorporated with software of specific building plans, systems, and the like. Furthermore, embodiments of the method of monitoring devices emitting a radio frequency may further comprise detecting a unique identifier number, such as an IMEI, of the device and reporting the unique identifier number to the computer.

Central monitoring software for monitoring signals detected by RF detection device 10 is also contemplated herein. Software may be configured to operate on either the computer 60 or the one or more remote computers 80 operably coupled to the RF detection device 10. In various embodiments, the central monitoring software is configured to accept and display graphical representation of one or more buildings. When displayed, embodiments of the central monitoring software are configured to display each of one or more RF detection devices located in the building(s). Embodiments of the software are also configured to generate customized activity reports to allow users to monitor and report on the RF detection device 10 in real time. Central monitoring software may, in some embodiments, include applications for mobile devices, such as but not limited to "smart phones" and tablet computers.

Embodiments of the central monitoring software are configured to pinpoint the location of unauthorized activity on interactive map of a building or geographic area. In systems utilizing two or more RF detection devices 10 with central monitoring software, the exact location of the unauthorized device may be calculated using a triangulation algorithm, and the reported to the computer 60 or the remote computer 80. Moreover, monitoring of the two or more RF detection devices may be conducted from a single remote compute 80 over network 70.

Embodiments of the central monitoring software are further configured to maintain long-term records of individual zones, rooms, buildings, geographical areas, etc. These records may be processed by the central monitoring software to calculate and display statistics, graphs, and detailed reports of each of the RF detection devices used in a system. The central monitoring software may be further configured to allow comments and notes to be added by authorized users for each alert recorded by RF detection device 10. Furthermore, the central monitoring software is, in various embodiments, configured to send alert reports to a desktop popup application, text message, email, and the like.

The central monitoring software is typically a web-based application. In some embodiments, the central monitoring software will be an executable program that runs on a single computer or a server. Embodiments of the central monitoring software are also configured for use with a "cloud" based system that runs on a computer at a server center accessed over the internet.

Embodiments of the RF detection device 10 described throughout this document may be utilized in a variety of settings, such as but not limited to prisons, buildings, campuses, secured events, casinos, SCIFs, and the like. By way of example and not as a limitation, several exemplary uses are described below.

In a prison setting, it is typical for guards to communicate with two-way radios. Inmates of the prison are, of course, typically prohibited from possessing cell phones or other electronic communication devices. While previous cell phone detection devices do not allow a user to differentiate between the permitted two-way radios of the guards and the unauthorized electronic communication devices of the inmates, embodiments of the RF detection device 10 disclosed herein allow for such a distinction. For example, a user may set the RF detection device to filter out the two-way radios. In such a setting, the RF detection device 10 only initiates an alert when a signal is detected within the frequency range set by the user. Thus, a use would preferably set an alert frequency range that excludes frequencies typical to two-way radios. By so doing, the user has filtered-out the two way radios. In addition or as an alternative, the RF detection device 10 may also be configured to initiate an alert when the signal detected is within a certain decibel level range. This would allow a prison to filter out, for example, devices outside of the prison that would register at a lower decibel level.

It will become apparent to a person having skill in the art how embodiments of the RF detection device 10 may be utilized in other settings. For example, a user may wish to detect any unauthorized electronic devices in only one room of a building. By adjusting the decibel sensitivity threshold to include only generally stronger frequencies, the user may filter out devices outside the room. Moreover, reference to and application of the information generated by the processor 20 on the user interface allows a user to "calibrate" the RF detection device to particular settings. For example, a user may first want to see what signal frequencies and decibel levels are common to a certain room or other geographical area. Once this has been determined by the RF detection device 10, the user may subsequently set the alert ranges to exclude the typical signal frequencies and the typical decibel levels. In such a scenario, the RF detection device 10 would only initiate an alert when RF frequencies outside the "normal" are detected.

In another exemplary use, embodiments of the RF detection device 10 may be used in an SCIF facility. In such a system, the RF detection device may be placed in an entry way to the SCIF or within the SCIF itself to detect any unauthorized mobile devices or unauthorized use of mobile devices. If an unauthorized device or use is detected, using aspects of embodiments described herein, an alert (such as an audio alert) initiated by the microprocessor 20 may give an indication to the carrier that such devices are not permitted. Alternatively or additionally, the microprocessor may initiate a signal to a remote monitoring station that an attempt is being made to smuggle an unauthorized device into the SCIF. Even further, the microprocessor 20 may initiate a signal to an external security device, such as a jammer, to disrupt use of the device.

In another exemplary use, embodiment of the RF detection device 10 may be used to monitor or prevent unauthorized use of devices on casino floors, or more particularly at gaming tables of casino floors. Devices in use at a gaming table often indicate cheating by a participant. Thus, the decibel sensitivity threshold of the RF detection device may be set by the user to detect frequencies within several feet of the RF detection device 10, thereby alerting the security monitoring the casino floor that someone is using a frequency transmission device at the table. The system may be further configured to alert security or other system users whether the detected signal comprises a short signal or an extended time signal. Short signals typically comprise automatic registration signals, while extended time signals typical comprise signal transmission of the device for an extended period of time. Thus, a short may not comprise unauthorized use, but rather a device sending a normal automatic registration signal to the nearest base station. Embodiments of the RF detection device 10, therefore, allow a user to filter out inconsequential short signals.

In another exemplary use, embodiments of the RF detection device 10 may be utilized in various facilities, such as but not limited to military buildings, prison facilities, government buildings, or any other buildings. In such systems, three or more RF detection devices 10 may be used to detect the frequency transmissions and decibel levels of devices within the building as a whole or more specifically certain rooms within the building. The three or more RF detection devices 10 are typically spaced equally apart (or overlapping in detection capability) and operably coupled to monitoring software. Through a series of testing, such as use of transmitting devices such as cell phones, a frequency/decibel may be generated to show on the map the exact location of the transmitting device. For example, a first RF detection device may report a signal detected with a frequency of 825 Mhz at 50 decibels, a second RF detection device may report a signal detected with a frequency 825 Mhz at 60 decibels, and a RF third detection device may report a signal detected with a frequency of 825 Mhz at 65 decibels. Through software that includes maps of the facility and triangulation algorithms, the exact location of the device in the building may be displayed on the user interface.

In another exemplary use, embodiments of the RF detection device 10 may be utilized in the fields of mass or individual transportation. For example, a system utilizing the RF detection device 10 may be utilized on an airplane to prevent unauthorized use of devices during prohibited times. Other systems utilizing the RF detection device may include automobiles, trucks, buses, trains, and/or motorcycles. The decibel sensitivity threshold in such systems may be set to only detect frequency transmission of devices within a predetermined distance—likely within the respective vehicle.

Any of the exemplary uses of the RF detection device 10 presented herein are for provided only for exemplary purposes, and not by way of limitation. Moreover, aspects described with reference to a particular use may be applied to any uses described throughout this document or otherwise apparent to a person having skill in the art upon consideration of the disclosures presented herein.

It will be understood that implementations are not limited to the specific components disclosed herein, as virtually any components consistent with the intended operation of a method and/or system implementation for RF detection devices may be utilized. Accordingly, for example, although particular RF detection devices may be disclosed, such components may comprise any shape, size, style, type, model, version, class, grade, measurement, concentration, material, weight, quantity, and/or the like consistent with the intended operation of a method and/or system implementation for an RF detection device may be used.

In places where the description above refers to particular embodiments of an RF detection device, system, or method, it should be readily apparent that a number of modifications may be made without departing from the spirit thereof and that these implementations may be applied to other RF detection devices. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

The invention claimed is:

1. A radio frequency detection device, comprising:

a housing;

a power supply port;

a radio frequency (RF) circuit board housed within the housing and electrically coupled the power supply port, the RF circuit board comprising an internal antenna;

a microprocessor housed within the housing and electrically coupled to the power supply port and the RF circuit board, the microprocessor configured to report a frequency of a detected signal, report a decibel level of the detected signal, initiate an alert when the detected signal is within one or more adjustable alert ranges, and ignore the detected signal when the detected signal is not within the one or more adjustable alert ranges.

2. The radio frequency detection device of claim 1, wherein the RF circuit board and the microprocessor are configured to detect frequencies between approximately 20 Mhz and 6020 Mhz, and the microprocessor comprises a 32 bit microprocessor.

3. The radio frequency detection device of claim 2, wherein the one or more adjustable alert ranges comprise an adjustable alert frequency range and a decibel sensitivity threshold.

4. The radio frequency detection device of claim 3, wherein the alert comprises one or more audio messages broadcast from a speaker electrically coupled to the microprocessor.

5. The radio frequency detection device of claim 4, wherein the one or more audio messages comprises a plurality of audio messages and the microprocessor is further configured to initiate a different one of the plurality of recorded messages upon detection of different signal frequencies or decibels.

6. The radio frequency detection device of claim 5, wherein the power supply port comprises at least one of an Ethernet port, a USB port, and AC adapter port, and an internal battery, and wherein the microprocessor is further configured to communicate with one or more external devices through at least one of the Ethernet port and the USB port.

7. A method of monitoring unauthorized use of one or more devices emitting a radio frequency in a secure area, comprising:

operably coupling a computer comprising a user interface to a first radio frequency detection device, the first radio frequency detection device comprising a microprocessor, a radio frequency circuit board comprising an antenna, and a communication port;

setting, through the user interface, a frequency alert range;

detecting, with the first radio frequency detection device, a signal of one or more devices, the signal of the one or more devices comprising a frequency and a decibel level;

initiating, by the microprocessor, an unauthorized use alert when the frequency of the signal detected by the first radio frequency detection device is within the frequency alert range; and ignoring the one or more devices by not initiating the unauthorized use alert when the frequency of the signal detected by the first radio frequency detection device is not within the alert frequency range.

8. The method of claim 7, further comprising setting, through the user interface, a sensitivity threshold, and wherein:

initiating the unauthorized use alert comprises initiating, by the microprocessor, the unauthorized use alert when the frequency of the signal detected by the first radio frequency detection device is within the frequency alert range and the decibel level of the signal detected is above the sensitivity threshold; and ignoring the one or more devices comprises ignoring the one or more devices by not initiating the unauthorized use alert when the frequency of the signal detected by the first radio frequency detection device is not within the alert frequency range or the decibel level of the signal detected is below the sensitivity threshold.

9. The method of claim 8, wherein:

initiating the unauthorized use alert comprises initiating, by the microprocessor, the unauthorized use alert when the signal detected comprises an extended time signal, the frequency of the signal detected by the first radio frequency detection device is within the frequency alert range, and the decibel level of the signal detected is above the sensitivity threshold; and ignoring the one or more devices comprises ignoring the one or more devices by not initiating the unauthorized use alert when the signal detected comprises an automatic registration signal, the frequency of the signal detected by the first radio frequency detection device is not within the alert frequency range, or the decibel level of the signal detected is below the sensitivity threshold.

10. The method of claim 8, wherein initiating, by the microprocessor, the alert comprises initiating, by the microprocessor, an audio alert message broadcast by a speaker electrically coupled to the microprocessor.

11. The method of claim 10, further comprising initiating an external security device operably coupled to the first radio frequency detection device when the decibel level of the signal detected by the first radio frequency detection device is above the decibel sensitivity threshold or the frequency of the signal detected by the first radio frequency detection device is within the alert frequency range.

12. The method of claim 11, wherein operably coupling the computer comprising the user interface to the first radio frequency detection device comprises operably coupling a computer comprising the user interface to the first radio frequency detection device with a communication cord extending between the computer and a communication port on the first radio frequency detection device, the communication port being electrically coupled to the microprocessor.

13. The method of claim 11, wherein operably coupling the computer comprising the user interface to the first radio frequency detection device comprises operably coupling the computer comprising the user interface to the first radio frequency detection device through a network.

14. The method of claim 13, further comprising:

operably coupling the computer to a second radio frequency detection device and at least a third radio frequency detection device, the second and at least third radio frequency detection devices each comprising a microprocessor, a radio frequency circuit board comprising an antenna, and a communication port;

setting, through the user interface, a frequency alert range for the second and at least third radio frequency detection devices;

setting, through the user interface, a sensitivity threshold for the second and at least third radio frequency detection devices;

detecting, with the second and third radio frequency detection devices, the signal of the one or more devices;

initiating, by the microprocessor of the second and third radio frequency detection devices, an unauthorized use alert when the frequency of the signal detected by the second and third radio frequency detection devices is within the frequency alert range or above the sensitivity threshold;

ignoring the one or more devices by not initiating the unauthorized use alert when the frequency of the signal detected by the second and at least third radio frequency detection devices is not within the alert frequency range or the decibel level of the signal detected is below the sensitivity threshold;

determining a location of the one or more devices by comparing the decibel level of the signal at each of the first, second, and at least third radio frequency detection devices;

showing the location of the one or more devices on a map on the user interface.

15. The method of claim 7, further comprising:

detecting a unique identifier number of the one or more devices;

reporting the frequency of the signal, the decibel level of the signal, and the unique identifier number of the one or more devices to the computer; and recording the frequency of the signal, the decibel level of the signal, and the unique identifier number of the one or more devices in a database.

16. A system for monitoring unauthorized use of one more devices emitting a radio frequency in a secured area, comprising:

one or more computers each configured to display a user interface;

one or more radio frequency detection devices operably coupled to the one or more computers, each of the one or more radio frequency detection devices comprising a power supply, a radio frequency circuit board electrically coupled to the power supply, an antenna, and a microprocessor electrically coupled to the power supply port and the radio frequency circuit board, the microprocessor configured to report a frequency of one or more detected signals to the one or more computers, report a decibel level of the one or more detected signals to the one more computers, and initiate an unauthorized use alert when the frequency of one or more detected signals is within an adjustable alert frequency range, wherein the adjustable alert frequency range is adjustable through the user interface and the user interface is configured to display the frequency and the decibel level of the one or more detected signals reported to the one or more computers.

17. The system of claim 16, wherein the microprocessor is further configured to initiate the unauthorized use alert when the decibel level of the one or more detected signals is above an adjustable decibel sensitivity threshold, the adjustable decibel sensitivity threshold being adjustable through the user interface.

18. The system of claim 17, wherein the one or more radio frequency detection devices comprises a plurality of radio frequency detection devices operable coupled to the one or more computers over a network.

19. The system of claim 18, further comprising an external security device operably coupled to at least one of the plurality of radio frequency detection devices and responsive to initiate a security measure when the microprocessor initiates the alert.

20. The system of claim 19, wherein the alert comprises an audio alert message broadcast by a speaker electrically coupled to the microprocessor.

* * * * *